US007377240B2

(12) United States Patent
Buehrle et al.

(10) Patent No.: US 7,377,240 B2
(45) Date of Patent: May 27, 2008

(54) METHOD FOR OPERATING AN INTERNAL COMBUSTION ENGINE

(75) Inventors: Ralf Buehrle, Hochberg (DE); Olivier Cois, Renningen (DE); Patrick Lanusse, Gradignan (FR); Alain Oustaloup, Talence (FR); Alexandre Wagner, Lagny/Marne (FR)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/543,633

(22) Filed: Oct. 4, 2006

(65) Prior Publication Data

US 2007/0088485 A1 Apr. 19, 2007

(30) Foreign Application Priority Data

Oct. 7, 2005 (DE) ..... 10 2005 048 048

(51) Int. Cl.
*F01L 1/34* (2006.01)

(52) U.S. Cl. ..... 123/90.15; 123/90.16; 123/90.17; 701/103

(58) Field of Classification Search ..... 123/90.15, 123/90.16, 90.17, 399, 568.21; 701/103; 361/152

See application file for complete search history.

(56) References Cited

U.S. PATENT DOCUMENTS

2005/0216179 A1* 9/2005 Yasui et al. ..... 701/115

* cited by examiner

*Primary Examiner*—Zelalem Eshete
(74) *Attorney, Agent, or Firm*—Kenyon & Kenyon LLP

(57) ABSTRACT

In a method for controlling an actuating device of a valve element of an intake system and/or an exhaust gas system of the internal combustion using an actuating variable, a periodic compensation signal is applied, at least intermittently, to the actuating device. The compensation signal generates a periodic counterforce at the valve element which is directed in the opposite direction from the periodic force exerted by the undesired disturbing vibrations of the valve element.

15 Claims, 4 Drawing Sheets

METHOD FOR OPERATING AN INTERNAL COMBUSTION ENGINE

FIELD OF THE INVENTION

The present invention relates to a method and a system for controlling an operation of an actuating device of a valve element of an intake system and/or an exhaust gas system of an internal combustion engine.

BACKGROUND INFORMATION

In modern internal combustion engines, the air flow in the intake system and/or the exhaust gas flow in the exhaust gas system are controlled or regulated by electronically controlled valve devices. The appropriate valve devices are, for example, a throttle valve, and exhaust gas recirculation valve, a bypass valve of a supercharger, etc. Such valve devices normally include a channel through which the air stream and the exhaust gas stream flow, a rotatable or displaceable valve element which controls the flow quantity as a function of its setting, an electrical actuating device, for instance a DC motor, a mechanical connection between the valve element and the actuating device, a sensor that records the current setting of the valve element, and a control and regulation device that ascertains the actuating signal that is applied to the actuating device in order to obtain a desired position of the valve element.

The known control and regulation devices typically include a digitized, closed control loop by which the actuating signal is determined that is applied to the actuating device. The basis for this is the actual value of the setting of the valve element recorded by the sensor and a setpoint value.

An object of the present invention is to provide a control method so that the internal combustion engine operates at as high an efficiency as possible, so that the fuel usage is optimized and the emission of pollutants is reduced.

SUMMARY OF THE INVENTION

In usual internal combustion engines, in normal operation, the flow in the intake channel as well as in the exhaust gas channel are subjected to periodic pressure fluctuations that are brought about by the discontinuous flow to and from the combustion chambers based on the opening and closing intake and exhaust valves. These pressure fluctuations generate periodic disturbing forces at a valve element of a valve device situated in such a channel, which lead to undesired vibrations ("disturbing vibrations") of this valve element, which, in turn, reduce the efficiency in the flow channel.

The method according to the present invention compensates for such disturbing vibrations of the valve element of a valve device situated in a flow channel, in that a compensation signal is generated which generates a periodic counterforce at the valve element which is directed in the opposite direction from the periodic force exerted by the air flow on the valve element. The disturbing vibrations of the valve element are reduced in this manner or are even completely eliminated, so that the air flow or the exhaust gas flow are able to flow past the valve element at a higher efficiency. Finally, the fuel consumption of the internal combustion engine is reduced thereby, and its exhaust emission behavior is improved.

In the process, the advantages according to the present invention are achieved without the dynamics of the valve device being made worse, for example, by mechanical damping elements. Lastly, the advantages according to the present invention are able to be implemented solely by a software design approach, by which an additional compensation signal is generated which is, for example, added to the actual actuating variable and which acts in the counterphase and at the same frequency and the same amplitude of the observed "disturbing vibrations."

It is particularly advantageous if the method according to the present invention is subdivided into an initialization portion and a compensation portion. During the initialization portion, the actual compensation of the undesired vibrations is prepared by ascertaining starting variables and/or fixed variables that are used in the generation of the compensation signal. The actual compensation signal is generated only during the compensation portion, and it is based, at least at the beginning, on the starting values ascertained during the initialization portion. As starting values, advantageously, first of all an amplitude and a phase of the current vibrations of the valve element are ascertained.

During the compensation portion, the properties of disturbing vibrations of the valve element, that are still present, continue to be currently recorded or ascertained, and are used to generate and/or optimize the compensation signal. In this context, the compensation signal is generally characterized by three essential parameters: amplitude, frequency and phase difference from the disturbing vibrations.

The amplitude of the compensation signal is advantageously ascertained while taking into consideration the starting amplitude ascertained during the initialization portion as fixed value, and a frequency of the current vibrations of the valve element. This is possible to do using little computation effort, and leads to a stable and surprisingly efficient optimization. In practice, a look-up table may be constructed for this purpose, using frequency analysis, from values previously recorded, for instance, on a test stand, which gives the appropriate amplitude of the compensation signal with the aid of the frequency used of the disturbing vibrations and the fixed starting amplitude.

The frequency of the compensation signal is optimally equal to the frequency of the disturbing vibrations, and the frequency, in turn, can in many cases be derived very simply from the current rotary speed of the internal combustion engine, namely, in all those cases in which the disturbing vibrations are related to the rotary speed-dependent, discontinuous charging and discharging of the combustion chambers.

The phase difference between the compensation signal and the disturbing vibrations of the valve elements corresponds to a starting value. The latter is ascertained in a similar way as the amplitude, as a function of the frequency of the disturbing vibrations and the starting phase ascertained during the initialization portion, which leads to a rapid reduction in the disturbing vibrations, while requiring small computational effort.

The method according to the present invention may use the phase difference as the optimization parameter. This means that the phase difference is changed within an admissible range in such a way that the ascertained amplitude of the current disturbing vibrations is minimized.

According to the present invention, a monitoring algorithm is provided for switching between initialization portion and compensation portion, which algorithm carries out the switching as a function of certain conditions. This may be implemented by software technology. The conditions are selected, in this instance, in such a way that it is ensured that the compensation signal has no undesired effect on the setting of the valve element. In particular, the functional section, and consequently the application of the compensation signal to the actuating element is terminated, and an initialization portion is initiated anew when certain parameters lie outside predefined ranges and/or the optimization of the phase difference that is carried out leads to no satisfactory result.

DETAILED DESCRIPTION

Figure 1:
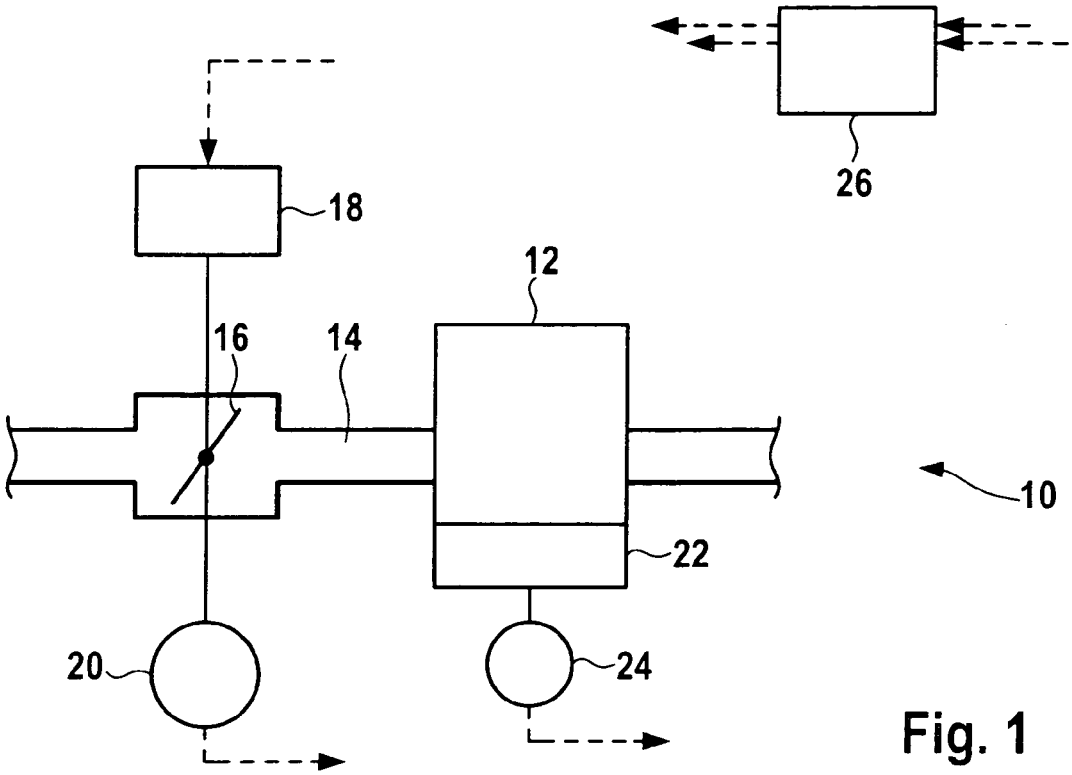
FIG. 1 shows a schematic representation of an internal combustion engine having a valve element configured as a throttle valve in an intake port.

In FIG. 1, the overall internal combustion engine bears reference numeral 10. It includes a motor block 12 having several combustion chambers, which are not individually shown, however, in FIG. 1. Combustion air is supplied to these chambers via an intake port 14, in which there is situated a throttle valve 16. In this respect, the throttle valve forms a valve element by which the fresh air quantity which reaches the combustion chambers of the internal combustion engine via intake port 14 is able to be adjusted.

The setting of throttle valve 16 is influenced by an actuating device 18, for instance, a DC motor or a stepper motor. The current setting of throttle valve 16 is recorded by a position sensor 20. A rotary speed of a crankshaft 22 of internal combustion engine 10 is recorded by a rotary speed sensor 24.

The operation of internal combustion engine 10 is controlled or regulated by a control or regulating device 26. To do this, among other things, an actuating variable is generated in control or regulating device 26, which is supplied to actuating device 18. The actuating variable, among other things, is a function of the signal of position sensor 20, so that a closed loop control circuit is formed.

The flow speed inside intake port 14 is subjected to periodic fluctuations which are caused by the discontinuous charging of combustion chambers of internal combustion engine 10. These fluctuations of the flow speed within intake port 14 are able to lead to undesired vibrations within intake port 14 ("disturbing vibrations") of throttle valve 16.

Figure 2:
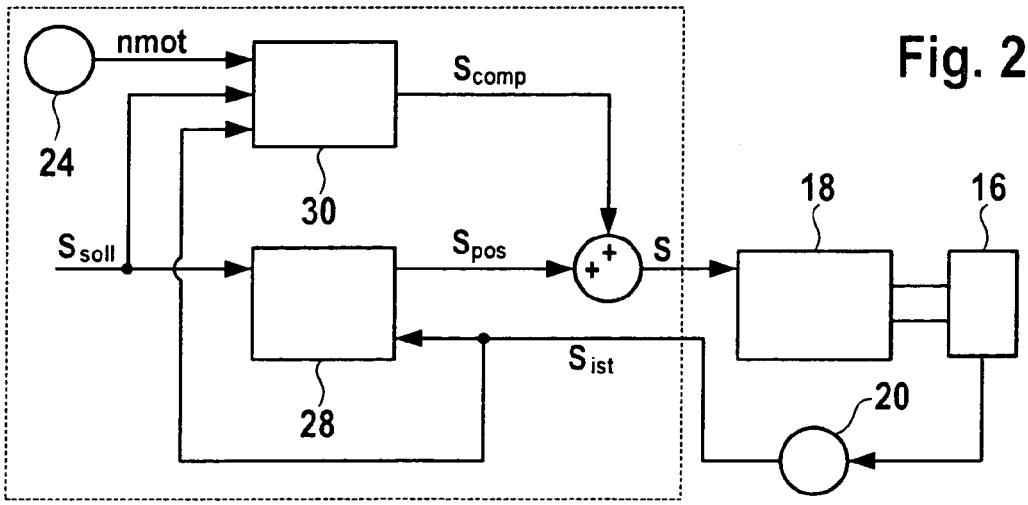
FIG. 2 shows a functional diagram for illustrating the generation of an actuating variable for controlling an actuating device of the throttle valve shown in FIG. 1, as well as a compensation signal that is applied to the actuating device.

As may be seen in FIG. 2, an actuating variable S is supplied to actuating device 18, which variable S is composed of a positioning signal $S_{pos}$ and a compensation signal $S_{comp}$.

Positioning signal $S_{pos}$ is generated within the scope of a closed loop control circuit in a control block 28. Into control block 28 there is fed, among others, a signal $S_{ist}$ (actual quantity) that corresponds to the setting of throttle valve 16, this signal being made available by position sensor 20, and a signal $S_{soll}$ (setpoint quantity) that corresponds to a desired setting of throttle valve 16. The latter is determined, for example, as a function of a desired torque of internal combustion engine 10.

Compensation signal $S_{comp}$ is determined in block 30 shown in FIG. 2, based on the current rotary speed nmot of crankshaft 22 of internal combustion engine 10, which speed nmot is ascertained by sensor 24, as well as based on actual quantity $S_{ist}$ and setpoint quantity $S_{soll}$. Position changes of throttle valve 16, which are provoked by the above-named flow fluctuations in intake port 14, are compensated for or at least reduced by compensation signal $S_{comp}$.

Figure 3:
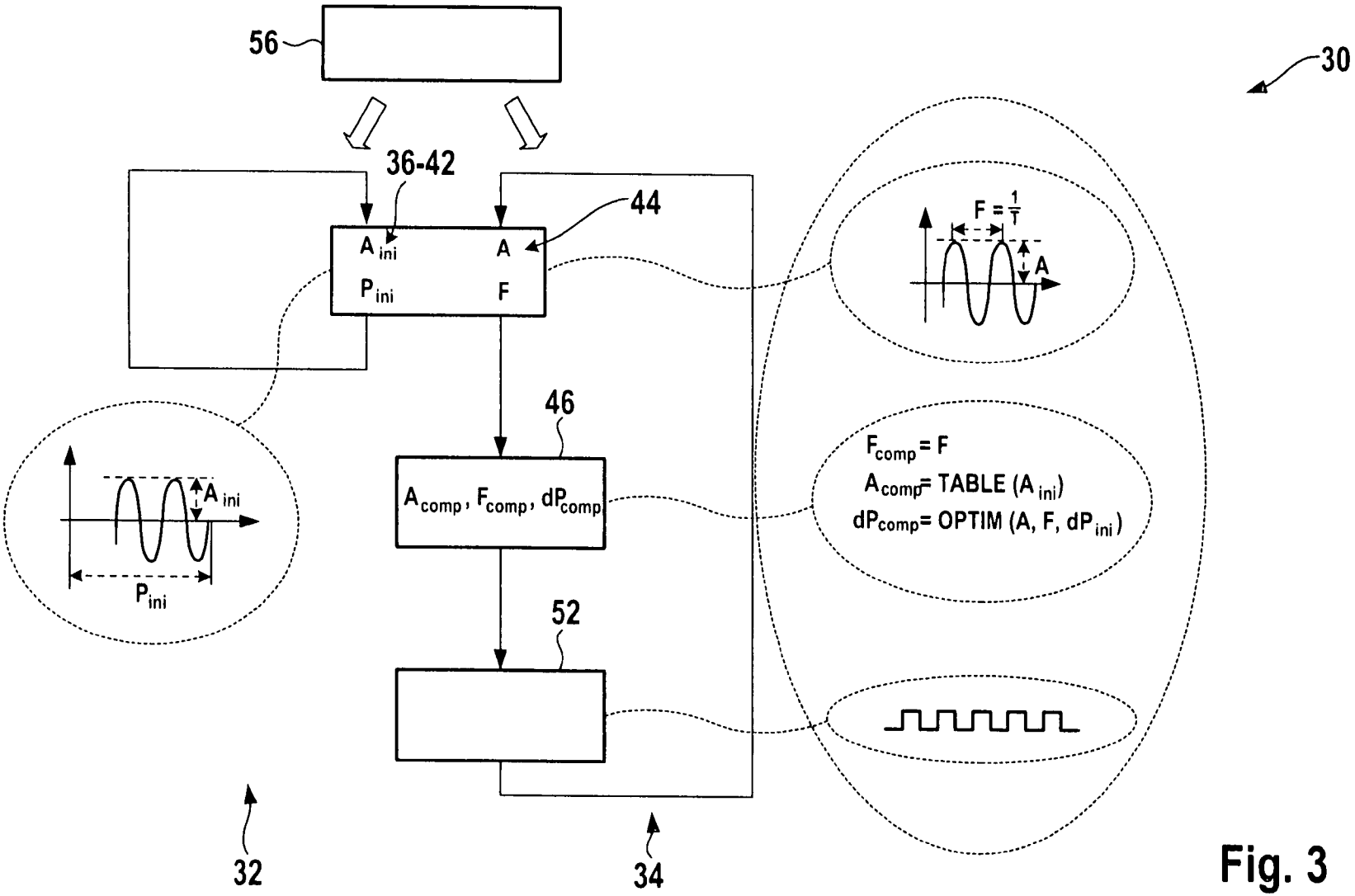
FIG. 3 shows a flowchart for illustrating a method for generating the compensation signal.

In block 30, for the generation of compensation signal $S_{comp}$, the method proceeds in two portions that are separate from each other (see FIG. 3): in an initialization portion 32, starting (or initial) variables $A_{ini}$ and $P_{ini}$ are determined for the ascertainment of compensation signal $S_{comp}$. As long as initialization portion 32 is running, a compensation signal $S_{comp}$ is not output. In a compensation portion 34, the actual parameters $A_{comp}$, $F_{comp}$, $dP_{comp}$ of compensation signal $S_{comp}$ are ascertained and compensation signal $S_{comp}$ is output. $A_{comp}$ is the amplitude, $F_{comp}$ is the frequency and $dP_{comp}$ is the phase difference of compensation signal $S_{comp}$ with respect to the disturbing vibrations.

Figure 4:
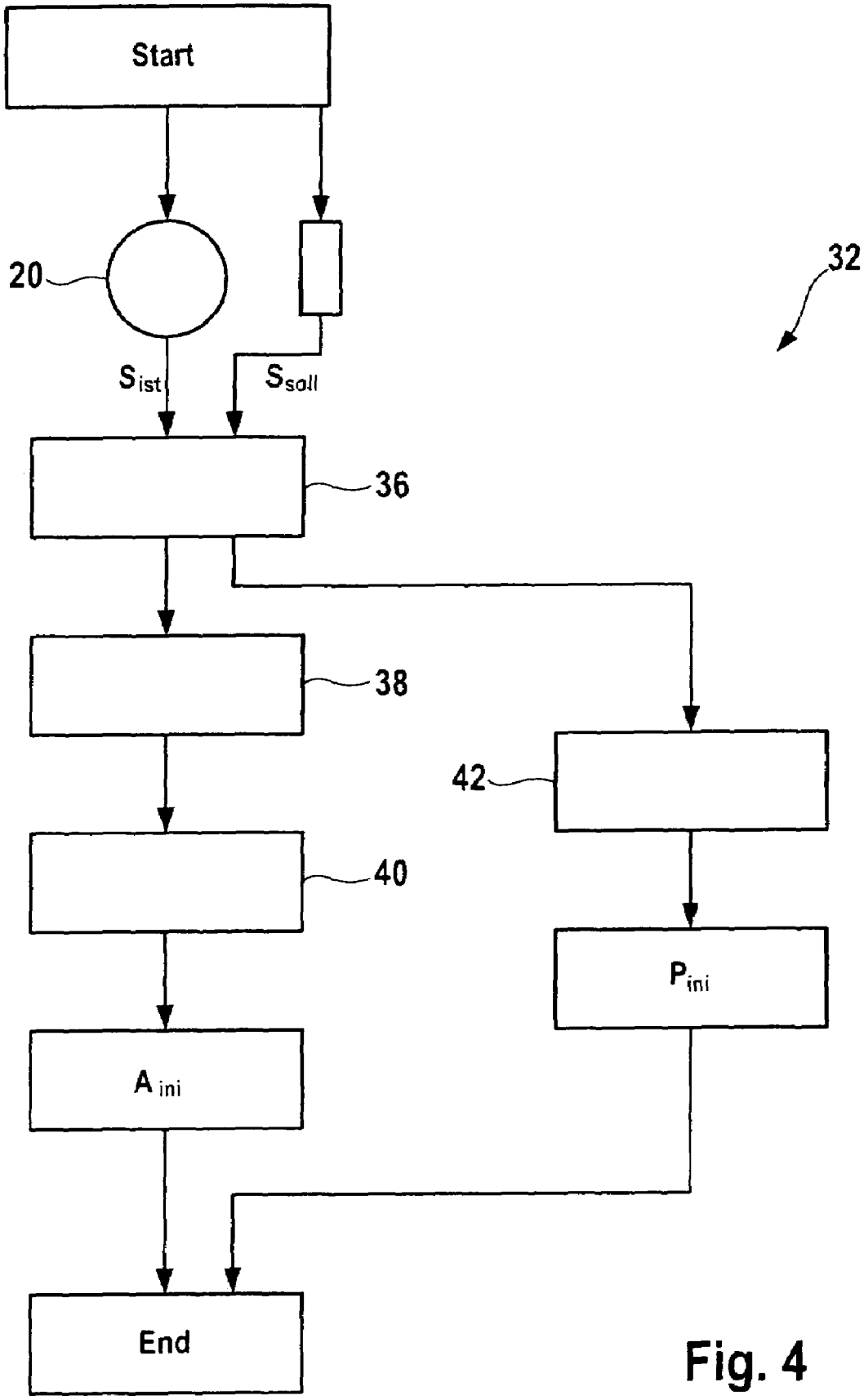
FIG. 4 shows a flow chart for illustrating an initialization portion of the method of FIG. 3.

The execution of initialization portion 32 will now be explained in greater detail, with reference to FIG. 4.

In initialization portion 32 a starting amplitude $A_{ini}$ and a starting phase $P_{ini}$ of the current disturbing vibrations are ascertained. To do this, first, in a block 36, the difference between the two signals $S_{ist}$ and $S_{soll}$, is formed ("difference signal"), and from this the absolute quantities are formed. In block 38, the maximum values that come about are recorded, and in block 40 signals formed from the maximum values are low-pass filtered. Finally, the starting amplitude is obtained by this nonlinear processing of signals $S_{ist}$ and $S_{soll}$.

A similar nonlinear processing leads to starting phase $P_{ini}$ in 42. For this, the last zero crossing before the end of initialization portion 32 of the absolute quantity of the difference signal determined in block 36 is recorded, and the starting phase that is determined is stored as reference value for periodic compensation signal $S_{comp}$.

Figure 5:
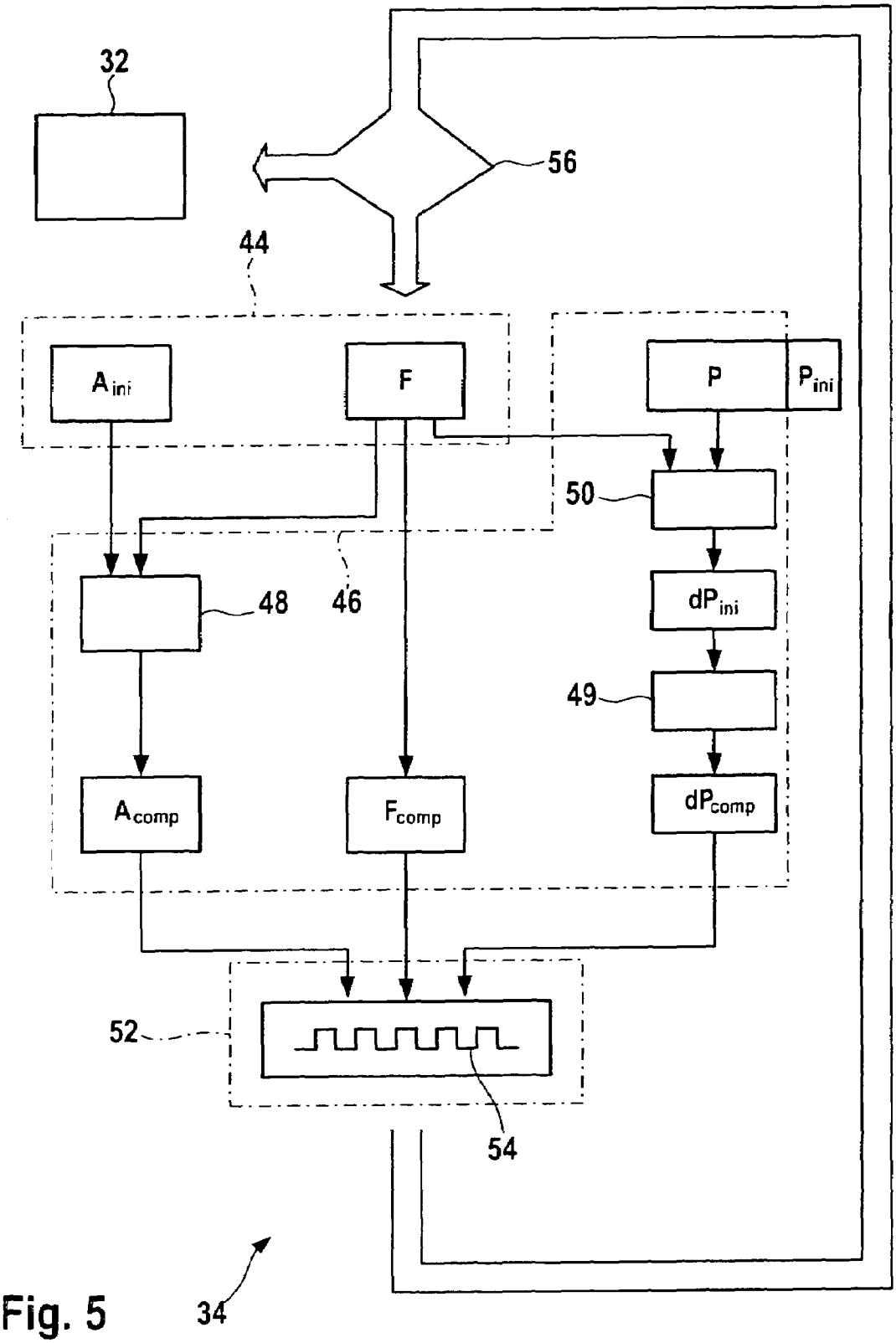
FIG. 5 shows a flow chart for illustrating a compensation portion of the method of FIG. 3.

The sequence of compensation portion 34 may be seen in detail in FIG. 5. Compensation portion 34 includes three steps: in a first step 44, the properties of the current disturbing vibrations are ascertained or updated. In the problem at issue, this refers to frequency F and amplitude A of the disturbing vibrations. The disturbing vibrations in intake port 14 considered in the present case are caused, as was explained above, by the discontinuous charging of the individual combustion chambers of internal combustion engine 10. The charging is directly coupled to rotary speed nmot of internal combustion engine 10, which, in turn is recorded by sensor 24. Therefore, frequency F of the disturbing vibrations is gathered in the present exemplary embodiment directly from current rotary speed nmot of crankshaft 22 of internal combustion engine 10. Amplitude A of the current disturbing vibrations is obtained, in turn, analogously to the method explained in connection with FIG. 4.

In a second step 46 within compensation portion 34, the properties and parameters $F_{comp}$, $A_{comp}$ and $dP_{comp}$ of periodic compensation signal $S_{comp}$ are determined, based on the parameters which were ascertained during initialization portion 32 and during first step 44 within compensation portion 34.

Frequency $F_{comp}$ of compensation signal $S_{comp}$ is set equal to frequency F of the disturbing vibrations that was ascertained in first step 44. Amplitude $A_{comp}$ of periodic compensation signal $S_{comp}$ is determined with the aid of a formula based on amplitude $A_{ini}$, which was ascertained during initialization portion 32, and frequency F. In the present exemplary embodiment, the formulaic connection in 48 is implemented by processing the elements of a look-up table. The elements of the look-up table, in turn, were obtained by a frequency analysis of values ascertained on a test stand.

Phase difference $dP_{comp}$ is obtained by an on-line optimization in 49. For this purpose, in the present exemplary embodiment, compensation signal $S_{comp}$ is changed starting from a starting value $dP_{ini}$ in such a way that amplitude A of the disturbing vibrations, ascertained in 44, decreases. Starting value $dP_{ini}$ for the phase difference is ascertained from a formula that is based on phase position $P_{ini}$, which was ascertained during initialization portion 32, and frequency F. Here, too, the implementation of the formulaic connection in 50 takes place by the processing of values stored in a look-up table. These values, in turn, were obtained from such values that were measured on a test stand, using frequency analysis.

Compensation portion 34 having online optimization 49 is carried out repeatedly in iterative fashion, so as to optimize phase difference $dP_{comp}$ of compensation signal $S_{comp}$, starting from starting value $dP_{ini}$ in such a way that amplitude A of the disturbing vibrations tends to a minimum. In the present case, a gradient-based algorithm is used as the online optimization algorithm.

A third step (reference numeral 52) in FIG. 5 of compensation portion 34 includes the determination and output of actual compensation signal $S_{comp}$, based on ascertained parameters $A_{comp}$, $F_{comp}$ and $dP_{comp}$. The ascertainment of compensation signal $S_{comp}$ is based on a time-periodic mathematical function that is characterized by frequency, amplitude and phase. In the present case, a square-wave signal 54 is selected for this time-periodic function.

The switchover between initialization portion 32 and compensation portion 34 takes place using a monitoring algorithm 56. Switchover is carried out from initialization portion 32 to compensation portion 34 when properties $A_{ini}$ and $P_{ini}$, that are required for compensation portion 34, of the current disturbing vibrations of throttle valve 16 have been recorded and ascertained.

The switchover in the opposite direction, that is, from compensation portion 34 to initialization portion 32, takes place when compensation signal $S_{comp}$ can no longer compensate for, or reduce the disturbing vibrations in the desired manner. This is detected in the present exemplary embodiment when frequency F and/or amplitude A lie outside a certain frequency range and amplitude range. The same applies to the case in which the absolute setting of throttle valve 16 lies outside a certain range. Finally, a switchover takes place from compensation portion 34 to initialization portion 32 when the online optimization of phase difference $dP_{comp}$ in 49 is not (any longer) in a position significantly to reduce amplitude A of the disturbing vibrations. An appropriate boundary value is able to be used for this too.

What is claimed is:

1. A method for operating an internal combustion engine, comprising:

controlling an actuating device of a valve element of at least one of an intake system and an exhaust-gas system of the internal combustion engine, wherein the actuating device is controlled using an actuating variable, and wherein a periodic compensation signal is applied, at least intermittently, to the actuating device;

wherein:

the controlling includes an initialization portion and a compensation portion;

during the initialization portion, at least one of starting quantities and fixed quantities are determined for ascertainment of the periodic compensation signal, and the periodic compensation signal is not applied to the actuating device; and during the compensation portion, the periodic compensation signal is applied to the actuating device.

2. The method as recited in claim 1, wherein at least one of a starting amplitude and a starting phase is ascertained by a nonlinear processing of a difference signal between an actual value and a setpoint value of a setting of the valve element.

3. The method as recited in claim 2, wherein the starting amplitude is ascertained by performing the steps of: ascertaining the absolute quantity of the difference signal; recording a resulting maximum value; and low-pass filtering the maximum value signal.

4. The method as recited in claim 2, wherein the starting phase is ascertained by an analysis of a last zero crossing of the difference signal before the end of the initialization portion.

5. The method as recited in claim 2, wherein, during the compensation portion, characteristic properties of vibrations of the valve element are one of recorded and ascertained, and the characteristic properties are used for at least one of generation and optimization of the periodic compensation signal.

6. The method as recited in claim 5, wherein the amplitude of the periodic compensation signal is ascertained by taking into consideration the starting amplitude ascertained during the initialization portion and a frequency of current vibrations of the valve element.

7. The method as recited in claim 6, wherein the frequency of current vibrations of the valve element is ascertained from a current rotary speed of the internal combustion engine.

8. The method as recited in claim 7, wherein a phase difference between the periodic compensation signal and the current vibrations of the valve element is adjusted starting from a starting value, whereby the amplitude of the current vibrations of valve element is reduced.

9. The method as recited in claim 8, wherein the starting value is ascertained by using the starting phase and the ascertained frequency of the current vibrations of the valve element.

10. The method as recited in claim 5, wherein a monitoring algorithm is provided to facilitate a switch, as a function of predetermined conditions, between the initialization portion and the compensation portion.

11. The method as recited in claim 10, wherein the monitoring algorithm facilitates a switch from the initialization portion to the compensation portion when the characteristic properties of the vibrations of the valve element for the compensation portion have been recorded.

12. The method as recited in claim 10, wherein the monitoring algorithm facilitates a switch from the compensation portion to the initialization portion when at least one of: a) the frequency of the valve element lies outside a predetermined range; b) the amplitude of the valve element lies outside a predetermined range; c) the absolute position of the valve element lies outside a predetermined range; and d) when a reduction of the vibrations of the valve element is less than or equal to a boundary value, based on the application of the periodic compensation signal to the actuating device.

13. The method as recited in claim 11, wherein the monitoring algorithm facilitates a switch from the compensation portion to the initialization portion when at least one of: a) the frequency of the valve element lies outside a predetermined range; b) the amplitude of the valve element lies outside a predetermined range; c) the absolute position of the valve element lies outside a predetermined range; and d) when a reduction of the vibrations of the valve element is less than or equal to a boundary value, based on the application of the periodic compensation signal to the actuating device.

14. A computer-readable storage medium storing a computer program configured to be executed by a computer, wherein the computer program performs, when executed by the computer, a method of controlling an operation of an internal combustion engine, the method comprising:

controlling an actuating device of a valve element of at least one of an intake system and an exhaust-gas system of the internal combustion engine, wherein the actuating device is controlled using an actuating variable, and wherein a periodic compensation signal is applied, at least intermittently, to the actuating device;

wherein the controlling includes an initialization portion and a compensation portion;

wherein, during the initialization portion, at least one of starting quantities and fixed quantities are determined for ascertainment of the periodic compensation signal, and the periodic compensation signal is not applied to the actuating device;

wherein, during the compensation portion, the periodic compensation signal is applied to the actuating device; and wherein at least one of a starting amplitude and a starting phase is ascertained by a nonlinear processing of a difference signal between an actual value and a setpoint value of a setting of the valve element.

15. A control device for an internal combustion engine, comprising:

an arrangement for controlling an actuating device of a valve element of at least one of an intake system and an exhaust-gas system of the internal combustion engine, wherein the actuating device is controlled using an actuating variable, and wherein a periodic compensation signal is applied, at least intermittently, to the actuating device;

wherein the controlling includes an initialization portion and a compensation portion;

wherein, during the initialization portion, at least one of starting quantities and fixed quantities are determined for ascertainment of the periodic compensation signal, and the periodic compensation signal is not applied to the actuating device;

wherein, during the compensation portion, the periodic compensation signal is applied to the actuating device; and wherein at least one of a starting amplitude and a starting phase is ascertained by a nonlinear processing of a difference signal between an actual value and a setpoint value of a setting of the valve element.

* * * * *